United States Patent [19]

Ames et al.

[11] Patent Number: 4,911,766

[45] Date of Patent: Mar. 27, 1990

[54] METHOD OF REFINING MAGNETIC DOMAINS OF ELECTRICAL STEELS USING PHOSPHORUS

[75] Inventors: S. Leslie Ames, Sarver; Jeffrey M. Breznak, Springdale, both of Pa.

[73] Assignee: Allegheny Ludlum Corporation, Pittsburgh, Pa.

[21] Appl. No.: 206,152

[22] Filed: Jun. 10, 1988

[51] Int. Cl.[4] ..... H01F 1/04

[52] U.S. Cl. ..... 148/113; 148/122

[58] Field of Search ..... 148/111, 112, 113, 122

[56] References Cited

U.S. PATENT DOCUMENTS

| | | | |
|---|---|---|---|
| 3,932,235 | 1/1976 | Foster, | 148/113 |
| 3,990,923 | 11/1976 | Takashina et al. | 148/111 |
| 4,655,854 | 4/1987 | Nishiike et al. | 148/111 |
| 4,750,949 | 6/1988 | Kobayashi et al. | 148/113 |

FOREIGN PATENT DOCUMENTS

| | | |
|---|---|---|
| 0193324 | 3/1986 | European Pat. Off. . |
| 61133321 | 11/1984 | Japan . |
| 61-284529 | 6/1985 | Japan . |
| 6251202 | 8/1985 | Japan . |
| 61-139679 | 6/1986 | Japan . |
| 2167324A | 5/1988 | United Kingdom . |

*Primary Examiner*—John P. Sheehan

*Attorney, Agent, or Firm*—Patrick J. Viccaro

[57] ABSTRACT

A method is provided for refining the magnetic domain wall spacing of grain-oriented silicon steel having a forsterite base coating thereon by removing portions of the base coating to expose a pattern of the underlying silicon steel, providing the exposed silicon steel with an environment selected from the group of phosphorus and phosphorus-bearing compounds, and then annealing the exposed steel, which is free of thermal and plastic stresses, in the phosphorus environment in a reducing atmosphere to produce in the steel a line of permanent bodies containing a phosphorus-bearing compound to effect heat resistant domain refinement and reduced core loss.

A semi-finished sheet product of final texture annealed grain-oriented silicon steel is also provided.

14 Claims, 3 Drawing Sheets

METHOD OF REFINING MAGNETIC DOMAINS OF ELECTRICAL STEELS USING PHOSPHORUS

BACKGROUND OF THE INVENTION

This invention relates to a method of improving core loss by refining the magnetic domain wall spacing. More particularly, the invention relates to a method of processing final texture annealed grain-oriented silicon steel having a forsterite base coating thereon to effect heat resistant domain refinement using the intrusion of phosphorus.

Grain-oriented silicon steel is conventionally used in electrical applications, such as power transformers, distribution transformers, generators, and the like. The steel's ability to permit cyclic reversals of the applied magnetic field with only limited energy loss is a most important property. Reductions of this loss, which is termed "core loss", is desirable.

In the manufacture of grain-oriented silicon steel, it is known that the Goss secondary recrystallization texture, (110)[001] in terms of Miller's indices, results in improved magnetic properties, particularly permeability and core loss over nonoriented silicon steels. The Goss texture refers to the body-centered cubic lattice comprising the grain or crystal being oriented in the cube-on-edge position. The texture or grain orientation of this type has a cube edge parallel to the rolling direction and in the plane of rolling, with the (110) plane being in the sheet plane. As is well known, steels having this orientation are characterized by a relatively high permeability in the rolling direction and a relatively low permeability in a direction at right angles thereto.

In the manufacture of grain-oriented silicon steel, typical steps include providing a melt having on the order of 2–4.5% silicon, casting the melt, hot rolling, cold rolling the steel to final gauge typically or 7 or 9 mils, and up to 14 mils with an intermediate annealing when two or more cold rollings are used, decarburizing the steel, applying a refractory oxide base coating, such as a magnesium oxide coating, to the steel, and final texture annealing the steel at elevated temperature in order to produce the desired secondary recrystallization and purification treatment to remove impurities such as nitrogen and sulfur. The development of the cube-on-edge orientation is dependent upon the mechanism of secondary recrystallization wherein during recrystallization, secondary cube-on-edge oriented grains are preferentially grown at the expense of primary grains having a different and undesirable orientation.

As used herein, "sheet" and "strip" are used interchangeably and mean the same unless otherwise specified.

It is also known that through the efforts of many prior art workers, cube-on-edge grain-oriented silicon steels generally fall into two basic categories: first, regular or conventional grain-oriented silicon steel, and second, high permeability grain-oriented silicon steel. Regular grain-oriented silicon steel is generally characterized by permeabilities of less than 1850 at 10 Oersteds with a core loss of greater than 0.400 watts per pound (WPP) at 1.5 Tesla at 60 Hertz for nominally 9-mil material. High permeability grain-oriented silicon steels are characterized by higher permeabilities which may be the result of compositional changes alone or together with process changes. For example, high permeability silicon steels may contain nitrides, sulfides, and/or borides which contribute to the precipitates and inclusions of the inhibition system which contribute to the properties of the final steel product. Furthermore, such high permeability silicon steels generally undergo cold reduction operations to final gauge wherein a final heavy cold reduction on the order of greater than 80% is made in order to facilitate the grain orientation. While such higher permeability materials are desirable, such materials tend to produce larger magnetic domains than conventional materials. Generally, larger domains are deleterious to core loss.

It is known that one of the ways that domain size and thereby core loss values of electrical steels may be reduced is if the steel is subjected to any of various practices designed to induce localized strains in the surface of the steel. Such practices may be generally referred to as ¢domain refining by scribing" and are performed after the final high temperature annealing operation. If the steel is scribed after the final texture annealing, then there is induced a localized stress state in the texture-annealed sheet so that the domain wall spacing is reduced. These disturbances typically are relatively narrow, straight lines, or scribes generally spaced at regular intervals. The scribe lines are substantially transverse to the rolling direction and typically are applied to only one side of the steel.

In fabricating these electrical steel into transformers, the steel inevitably suffers some deterioration in core loss quality due to cutting, bending, and construction of cores during fabrication, all of which impart undesirable stresses in the material. During fabrication incident to the production of stacked core transformers and, more particularly, in the power transformers of the United States, the deterioration in core loss quality due to fabrication is not so severe that a stress relief anneal (SRA) is essential to restore usable properties. For such end uses, there is a need for a flat, domain-refined silicon steel which will not be subjected to stress relief annealing. In other words, the scribed steel used for this purpose does not have to possess domain refinement which is heat resistant.

However, during the fabrication incident to the production of most distribution transformers in the United States, the steel strip is cut and subjected to various bending and shaping operations which produce much more worked stresses in the steel than in the case of power transformers. In such instances, it is necessary and conventional for manufacturers to stress relief anneal (SRA) the product to relieve such stresses. During stress relief annealing, it has been found that the beneficial effect on core loss resulting from some scribing techniques, such as mechanical and thermal scribing, are lost. For such end uses, it is required and desired that the product exhibit heat resistant domain refinement (HRDR) in order to retain the improvements in core loss values resulting from scribing.

It has been suggested in prior patent art that contaminants or intruders may be effective for refining the magnetic domain wall spacing of grain-oriented silicon steel. Takashina et al, U.S. Pat. No. 3,990,923—dated Nov. 9, 1976, discloses that chemical treatment may be used on primary recrystallized silicon steel to control or inhibit the growth of secondary recrystallization grains. British patent application No. 2,167,324A discloses a method of subdividing magnetic domains of grain-oriented silicon steels to survive an SRA. The method includes imparting a strain to the sheet, forming an intruder on the grain-oriented sheet, the intruder being of a different component or structure than the electrical sheet and doing so either prior to or after straining and thereafter annealing such as in a hydrogen reducing atmosphere to result in imparting the intruders into the steel body. Numerous metals and nonmetals are identified as suitable intruder materials.

Japanese Patent Document 61-133321A discloses removing surface coatings from final texture annealed magnetic steel sheet, forming permeable material coating on the sheet and heat treating to form material having components or structure different than those of the steel matrix at intervals which provide heat resistant domain refinement.

Japanese Patent Document 61-139-679A discloses a process of coating final texture annealed oriented magnetic steel sheet in the form of linear or spot shapes, at intervals with at least one compound selected from the group of phosphoric acid, phosphates, boric acid, borates, sulfates, nitrates, and silicates, and thereafter baking at 300°–1200° C., and forming a penetrated body different from that of the steel to refine the magnetic domains.

Japanese Patent Document 61-284529A discloses a method of removing the surface coatings from final texture annealed magnetic steel sheets at intervals, coating one or more of zinc, zinc alloys, and zincated alloy at specific coating weights, coating with one or more of metals having a lower vapor pressure than zinc, forming impregnated bodies different from the steel in composition or in structure at intervals by heat treatment or insulating film coating treatment to refine the magnetic domains.

Japanese Patent Document 62-51202 discloses a process for improving the core loss of silicon steel by removing the forsterite film formed after final finish annealing, and adhering different metal, such as copper, nickel, antimony by heating.

A copending application, Ser. No. 205,711, filed June 10, 1988, by the Assignee of this invention discloses a method for refining the magnetic domain wall spacing of grain-oriented silicon steels having an insulation base coating thereon by the use of metallic contaminants. In another copending application, Ser. No. 206,051, filed June 10, 1988, by the Assignee of this invention, there is disclosed another method for refining the domain wall spacing by applying a barrier coating to the forsterite prior to applying a metallic contaminant to a pattern of exposed steel being free of thermal and plastic stresses.

What is needed is a method for providing heat resistant domain refinement which is compatible with conventional processing of regular and high permeability grain-oriented silicon steels and which is not dependent on a particular technology, such as laser, electrical discharge, or electron beam technology, for removing the base coating in desired patterns on the steel. The method should use the insulative coating, i.e., the forsterite base coating, on grain-oriented silicon steel sheet to facilitate domain refining.

SUMMARY OF THE INVENTION

In accordance with the present invention, a method of refining the magnetic domain wall spacing of grain-oriented silicon steel having an insulation coating is provided. The method comprises removing portions of the insulation coating to provide a limited exposure of the underling silicon steel in a pattern of lines, providing the silicon steel with an environment selected from the group of phosphorus and phosphorus-bearing compounds to the exposed steel which is free of thermal and plastic stresses and is not dependent on such stresses for effective domain refinement. Thereafter, annealing the exposed steel having the phosphorus environment in a reducing atmosphere at time and temperature to produces line of permanent bodies containing a phosphorus-bearing compound in the exposed steel area to effect heat resistant domain refinement and reduced core loss.

DETAILED DESCRIPTION OF THE PREFERRED EMBODIMENTS

Figure 1:
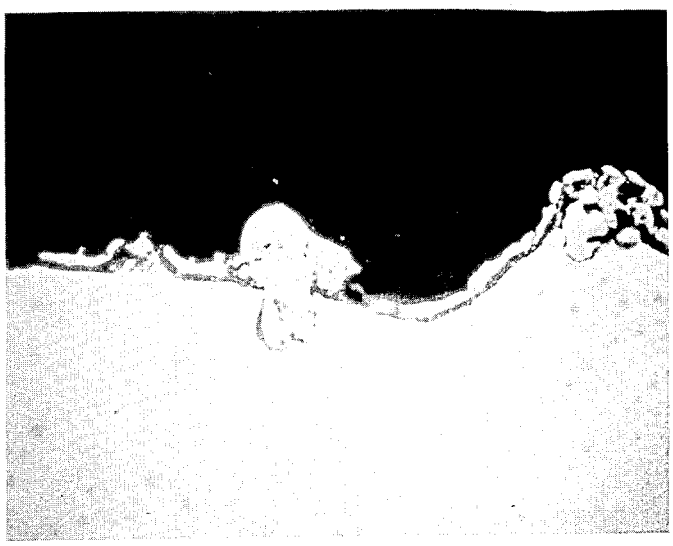
FIG. 1 is an 800X photomicrograph in cross section of typical structure in base coating groove of Example I.

Broadly, in accordance with the present invention, a method is provided for improving the magnetic properties of regular and high permeability grain-oriented silicon steels having relatively large grain size and correspondingly relatively large magnetic domain wall spacing. Preferably, the method is useful for treating such steels to effect a refinement of the magnetic domain wall spacing for improving core loss values of the steel strip such that they are heat resistant. The width of the scribed or treated lines and the spacing of the treated regions or lines being substantially transverse to the rolling direction of the silicon strip may be conventional. What is not conventional, however, is the method of the present invention for effecting such magnetic domain wall spacing by the controlled contamination, in surface bands or stripes, using phosphorus and phosphorus compounds such that the steel so treated has improved magnetic properties of core loss resulting from the produced heat resistant domain refinement.

Although the present invention described in detail herein has utility with electrical steel generally, and particularly 2.0–4.5% silicon electrical steels, such steels may be of the conventional grain-oriented or high permeability grain-oriented type. Such steels having relatively high permeability such as greater than 1850 at10 Oersteds usually have correspondingly relatively large grain size and would respond well to various types of domain refining techniques. As used herein, the steel melt initially contained the nominal composition of:

| C | N | Mn | S | Si | Cu | B | Fe |
|---|---|---|---|---|---|---|---|
| .030 | Less than 50 ppm | .038 | .017 | 3.15 | .30 | 10 ppm | Bal. |

The steel is a high permeability grain-oriented silicon steel. Unless otherwise noted herein, all composition ranges are in weight percent.

The method starting material for the chemical stripping process of the present invention includes final texture annealed grain-oriented silicon steel sheet having an insulation coating thereon. Such an insulative coating can be the conventional base coating, also called forsterite or mill glass, typically found on such silicon steels. Preferably, the as-scrubbed final texture annealed grain-oriented silicon steels may be used.

The method includes removing portions of the base coating to expose a line pattern of the underlying silicon steel so as to expose that steel. In accordance with the present invention, it is important that portions of the coating be removed to expose a pattern of the underlying silicon steel. How the coating is removed is not critical to the present invention except that the underlying steel need not be subjected to any mechanical, thermal, or other stresses and strains as a result of the coating removal operation. In other words, the exposed steel must be free of any thermal and plastic stresses prior to any subsequent steps of applying the metallic contaminant. An advantage of the present invention is that any of various techniques may be used to remove the selected portions of the base coating. For example, conventional mechanical scribing or laser means may be used to develop a controlled pattern of markings on the strip surface. The line or stripe pattern selected for the removed base coating may be conventional patterns used in prior art scribing techniques. Preferably, the pattern may comprise removing the coating in lines substantially transverse to the rolling direction of the steel having a line width and spacing as may be conventional. Other patterns may also be useful, depending on whether the grain-oriented silicon steel is of the cube-on-edge, cube-on-face, or other orientation. As used herein, the pattern of exposed bare metal lines is referred to as "metal stripes."

The method also provides the silicon steel with an environment selected from the group of phosphorus and phosphorus-bearing compounds from which the controlled contamination of phosphorus into the steel surface can occur. By phosphorus or phosphorus-bearing compounds, it is meant that the environment contains sufficient phosphorus in order to react with the steel and to attack and diffuse into the exposed silicon steel in the pattern defined by the removal of portions of the base coating. Typical phosphorus-bearing coating compounds are shown in Table I, the composition mixtures based on 1 liter of water. Although it is preferred to provide phosphorus-bearing compounds in the form of coatings, other sources of phosphors may be equally suitable, such as pure phosphorus in powder or solid form. The amount of concentration of phosphorus present does not appear to be critical because even minute amounts seem to preferentially attack the limited or constricted exposure of silicon-iron steel.

TABLE I

| Designation | Composition | Concentration |
|---|---|---|
| SC | Phosphoric Acid (85%) | 202 gm/l |
| | Magnesium Oxide | 22 gm/l |
| | Nalcoag (1050) | 318 ml/l |
| | Chromic Trioxide | 46 gm/l |
| | Water | Balance |
| | Cured: 1000° F. - 1 min. (air) | |
| PS | Phosphoric Acid (85%) | 120 gm/l |
| | Magnesium Oxide | 18 gm/l |
| | Kasil #1 | 22 gm/l |
| | Ammonium Hydroxide (58%) | 21 ml/l |
| | Chromic Trioxide | .34 gm/l |
| | Dupanol (2%) | 1.0 ml/l |
| | Water | Balance |
| | Cured: 800° F. - 1 min. (air) | |

TABLE I-continued

| Designation | Composition | Concentration |
|---|---|---|
| P | Phosphoric Acid | 118 gm/l |
| | Magnesium Oxide | 18 gm/l |
| | Ammonium Hydroxide (58%) | 20 ml/l |
| | Chromic Trioxide | .34 gm/l |
| | Dupanol (2%) | 1.0 ml/l |
| | Water | Balance |
| | Cured: 800° F. - 1 min. (air) | |

When applied to the silicon steel surface, the phosphorus-source layer may be applied by any conventional means such as dip or roller coating and subsequently air cured. The coating may be applied in thicknesses ranging from about 0.03 to 0.15 mils (0.75 to 2.25 microns) and may be applied at such thickness to either one or both sides of the steel strip. When applied directly to the steel strip either on or in the vicinity of the exposed metal stripes, and subsequently heated in a reducing atmosphere, the phosphorus will migrate along the silicon steel surface to the areas of exposed iron where it reacts to form wedge-shaped iron phosphide bodies or particles rooted in the steel. The phosphorus and phosphorus-bearing compounds in the environment may also be vapor deposited into the silicon steel exposed areas by techniques, such as described below. If the phosphorus and phosphorus-bearing compounds are provided as a coating to the silicon steel on the surface wherein the base coating has or will be removed to expose the underlying silicon steel metal stripes, then the coating may be applied either before or after metal striping. If the phosphorus is to be provided through vapor deposition, then the metal striping must be done prior to providing the phosphorus in vapor form.

The method includes annealing the exposed steel having the phosphorus environment in a reducing atmosphere at time and temperature to produce a line of permanent wedge-shaped bodies or particles. The reducing atmosphere may include hydrogen and hydrogen mixtures such as nitrogen-hydrogen mixtures. Hydrogen is a known reducing atmosphere for phosphorus-containing compounds.

In order to better understand the present invention, the following examples are presented. For each example, the steel was produced by casting, hot rolling, normalizing, cold rolling to final gauge with an intermediate annealing when two or more cold rolling stages were used, decarburizing, coating with MgO and final texture annealing to achieve the desired secondary recrystallization of cube-on-edge orientation. After decarburizing the steel, a refractory oxide base coating containing primarily magnesium oxide was applied before final texture annealing at elevated temperature, such annealing causing a reaction at the steel surface to create a forsterite base coating. Although the steel melts initially contained the nominal compositions recited above, after final texture annealing, the C, N, and S were reduced to trace levels of less than about 0.001% by weight.

Example I

To illustrate the several aspects of the domain refining process of the present invention, silicon steel having the composition described above was processed as described above to a final gauge of about 9 mils. The samples were magnetically tested as received and used as control samples. One surface of the steel was coated with the "P" coating identified in Table I and then mechanically scratched to remove portions of the base coating to expose the underlying silicon steel as metal stripes. The removed base coating was in generally parallel lines extending substantially transverse to the rolling direction of the steel about 5 mm apart and with each line typically about 100 microns wide. All of the samples were then annealed at 1650° F. (899° C.) in a reducing atmosphere of either hydrogen or a mixture of 90/10 nitrogen/hydrogen as indicated. All of the strips (base coated, then coated with the "P" coating) were 30 cm long×3 cm wide so to be able to form Epstein test packs. The magnetic properties of core loss at 60 Hertz (Hz) at 1.5 and 1.7 Tesla, permeability at 10 Oersteds (H) were determined in a conventional manner for Epstein packs after final texture annealing (original tests) and after domain refined in accordance with the present invention. Percentages in parentheses indicate change compared to original properties.

TABLE II

| Pack No. | Sample Condition | Magnetic Properties: Permeability @10H | Core Loss @1.5T (wpp) | Core Loss @1.7T (wpp) |
|---|---|---|---|---|
| Hydrogen Reaction - Anneal | | | | |
| B6 | As P Coated | 1947 | .460 | .621 |
| | Striped, + 5 hr. anneal at 1650° F. | 1952 | .428 (−7) | .574 (−8) |
| | As above + further 5 hr. anneal at 1650° F. | 1953 | .429 (−7) | .579 (−7) |
| 90/10 Nitrogen/Hydrogen Reaction - Anneal | | | | |
| B8 | As P Coated | 1943 | .436 | .595 |
| | Striped + 5 hr. anneal at 1650° F. | 1946 | .425 (−3) | .581 (−2) |
| | As above + further 5 hr. anneal at 1650° F. | 1947 | .400 (−8) | .540 (−9) |

Under the experimental conditions described above, Table II shows the effects of the domain refinement on the magnetic properties of the grain-oriented silicon steel samples. The magnetic properties were determined after 5 hours at 1650° F. and again after an additional 5 hours at that temperature. The data show that a 7 to 8% improvement in core loss at 1.5 and 1.7 Tesla were obtained with the improvements occurring at shorter annealing cycles for the material annealed in 100% hydrogen.

Figure 2:
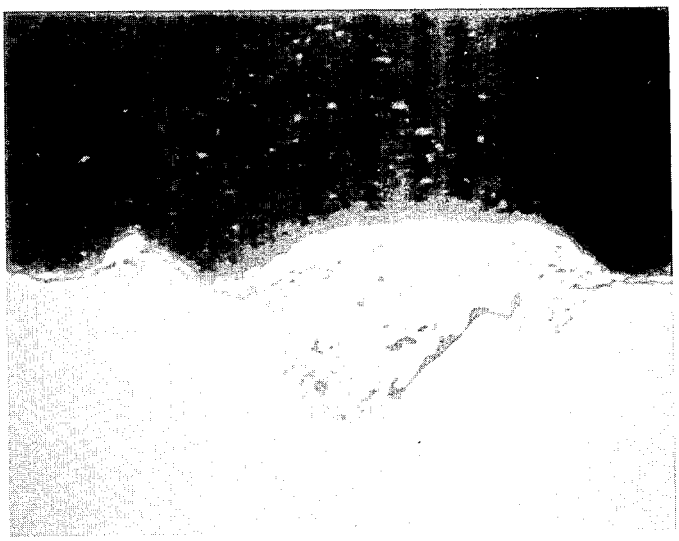
FIG. 2 is an 800X photomicrograph in cross section of another typical structure in base coating groove of Example I.

Examination under the Scanning Electron Microscope (SEM) revealed massive phosphorus attack in the pattern marks on the surface of the exposed silicon steel. The attack was most intense in the periphery of the scribe line resulting from the surface migration of the phosphorus and is visualized as starting at the small ridges of metal often found to have been forced upwards at edges of scribe marks when mechanical scribing occurs. FIG. 1 illustrates a photomicrograph at 800X in cross section through the groove in the base coating and shows the attack along the edges of the groove. More particularly, the iron phosphide growth as the "wedge-like" body is typical resulting from the phosphorus attack in accordance with the method of the present invention. Such a wedge-like body buries itself into the matrix of the silicon steel substrate. FIG. 2 is a photomicrograph of 800X in cross section showing another typical growth of the phosphide but this time completely filling the groove or channel marked through the base coating.

In addition to the iron phosphide in the vicinity of the patterned grooves in the base coating, a random dispersion of relatively small phosphide nodules were also sometimes found on the surface of the silicon steel. SEM photographs of such nodules also shows the wedge-like appearance which could adversely affect the magnetic domain structure of the silicon steel. Such random dispersion of the nodules probably results from pores, cracks, or other defects in the forsterite base coating. To further assess such random dispersion of the phosphides, similar tests were performed on final texture annealed silicon steels having the forsterite or base coatings removed. Following the "P" coating and anneal at 1650° F. in hydrogen, the iron phosphides were found to have formed uniformly as a thin film covering the whole sample. No wedge-like particles were embedded in the steel matrix. It would appear that a constricted or limited access to the underlying steel matrix as provided by metal striping is necessary and important for the wedge shaped particles to be formed.

Example II

By way of further examples, additional tests were performed to demonstrate a lower diffusion annealing temperature. All of the samples were obtained from various heats of nominally 9-mil gauge material and were prepared in a manner similar to that in Example I but annealed under the experimental conditions described in Table III. The magnetic properties were measured both as single strip and as an Epstein pack containing eight strips. Percentages in parentheses indicate change compared to initial properties.

TABLE III

| Sample No. VDTS | Initial As-Scrubbed Properties: Permeability @10H | Core Loss @1.5T (wpp) | Core Loss @1.7T (wpp) | P-Coated and Metal Striped: Permeability @10H | Core Loss @1.5T (wpp) | Core Loss @1.7T (wpp) | Annealed 7½ Hrs. @ 1525° F. in Hydrogen: Permeability @10H | Core Loss @1.5T (wpp) | Core Loss @1.7T (wpp) | Second Anneal 7½ Hrs. @ 1525° F. in Hydrogen: Permeability @10H | Core Loss @1.5T (wpp) | Core Loss @1.7T (wpp) |
|---|---|---|---|---|---|---|---|---|---|---|---|---|
| 49 | 1903 | .523 | .738 | 1898 | .367 | .508 | 1893 | .404 | .567 | 1871 | .385 | .560 |
| 50 | 1881 | .543 | .783 | 1873 | .373 | .528 | 1866 | .532 | .768 | 1855 | .376 | .554 |
| 51 | 1928 | .596 | .780 | 1921 | .356 | .485 | 1909 | .431 | .593 | 1887 | .368 | .507 |
| 52 | 1892 | .471 | .704 | 1885 | .406 | .576 | 1881 | .463 | .670 | 1857 | .376 | .542 |
| 53 | 1926 | .463 | .644 | 1923 | .365 | .508 | 1911 | .407 | .558 | 1889 | .384 | .531 |
| 54 | 1887 | .538 | .770 | 1883 | .395 | .571 | 1876 | .538 | .762 | 1859 | .402 | .593 |
| 55 | 1909 | .475 | .653 | 1890 | .400 | .563 | 1894 | .434 | .593 | 1877 | .407 | .559 |
| 56 | 1932 | .435 | .592 | 1918 | .353 | .477 | 1915 | .394 | .529 | 1895 | .379 | .514 |
| Average | 1909 | .505 | .711 | 1900 | .364 | .527 | 1893 | .450 | .630 | 1874 | .385 | .545 |
| Single Strip | | | | | (−28) | (−26) | | (−11) | (−11) | | (−24) | (−23) |
| Epstein Pack Test on above | 1916 | .446 | .623 | 1902 | .385 (−14) | .532 (−15) | 1903 | .401 (−10) | .545 (−13) | 1887 | .372 (−17) | .512 (−18) |

TABLE III-continued

| Sample No. VDTS | Initial As-Scrubbed Properties Permeability @10H | Core Loss @1.5T (wpp) | Core Loss @1.7T (wpp) | P-Coated and Metal Striped Permeability @10H | Core Loss @1.5T (wpp) | Core Loss @1.7T (wpp) | Annealed 7½ Hrs. @ 1525° F. in Hydrogen Permeability @10H | Core Loss @1.5T (wpp) | Core Loss @1.7T (wpp) | Second Anneal 7½ Hrs. @ 1525° F. in Hydrogen Permeability @10H | Core Loss @1.5T (wpp) | Core Loss @1.7T (wpp) |
|---|---|---|---|---|---|---|---|---|---|---|---|---|
| 8 strips | | | | | | | | | | | | |

Under the experimental conditions described, good results were obtained when compared to the initial as-scrubbed condition having the forsterite coating thereon and as compared to the properties resulting in the removal of the base coating and the inherent improvement resulting from the unintentional marking of the steel resulting from the mechanical removal process. The data show that even after 15 hours at the lower temperature of 1525°, the permanent body containing a phosphorus-bearing compound effected heat resistant domain refinement and reduced core loss. The core loss improvements range from 17 to 18% for the Epstein packs and about 23 to 24% for the Epstein single strip properties.

Figure 3:
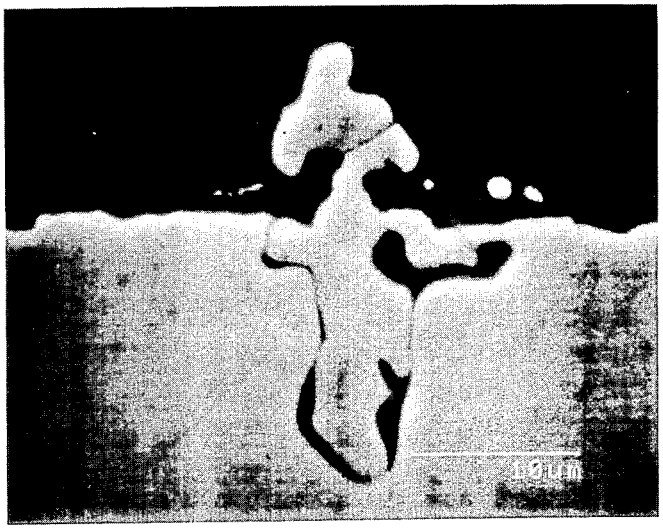
FIG. 3 is a 3000X photomicrograph in cross section of wedge-like body in base coating.

FIG. 3 is a photomicrograph in cross section at 3000X showing the wedge-like shape of the permanent body, i.e., the iron phosphide particle, found as a randomly dispersed nodule on the surface of the steel.

Example III

By way of further examples, additional tests were performed to demonstrate the phosphorizing effect through a vapor phase. Each sample was prepared in a manner similar to that in Example I except that the as-scrubbed silicon steels having the forsterite coating thereon were subjected to mechanical scratching for removing portions of the base coating without applying a coating containing phosphorus or phosphorus-bearing compounds. Dummy samples of 11-mil electrical silicon steel were coated with the "P" coating of Table I and were to be used as the phosphorus source. The samples and the dummy donor sample strips were stacked alternately with a layer of alumina powder interposed to prevent direct contact between the test samples and the dummy samples. The whole pack of 17 strips was then heated in hydrogen at 1650° F. for 5 hours. Magnetic properties were obtained in a conventional manner on two sets of eight Epstein strips tested both as single strips and as Epstein packs.

The data of Tables IV and V clearly demonstrate that the phosphorus contamination or striping by vapor deposition or vapor transfer can be an effective heat resistant domain refinement. The level of core loss achieved as a result of the method of the present invention is an improvement even over conventional mechanical scribing which does not, in fact, survive subsequent heat treatment or annealing. An examination under SEM identified several characteristic differences between the samples treated in accordance with the vapor transfer and those resulting from the surface migration of phosphorus. In the Examples I and II, the phosphorus attack primarily occurred at the peripheral of the grooves in the base coating whereas for the vapor transfer of Example III, the phosphorus attack was substantially in the center of the groove through the base coating. As a result, the groove became filled and if allowed to continue would become overflowing and protrude upwardly from the top surface of the steel sheet.

Figure 4:
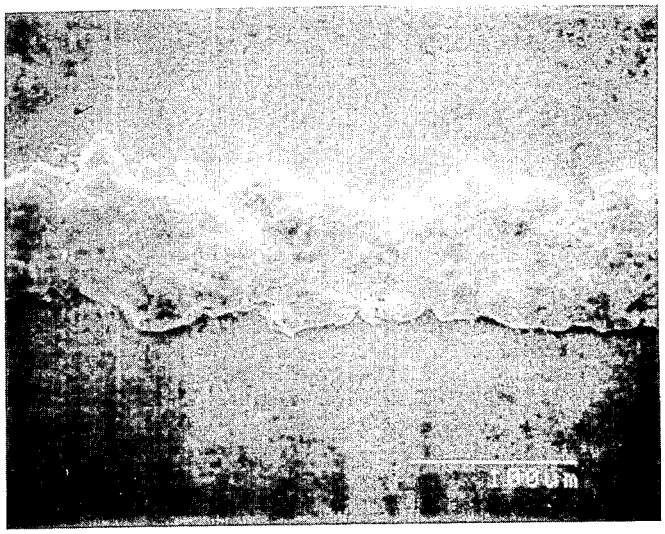
FIG. 4 is a 300X photomicrograph in cross section of structure by vapor deposition of Example III.
Figure 5:
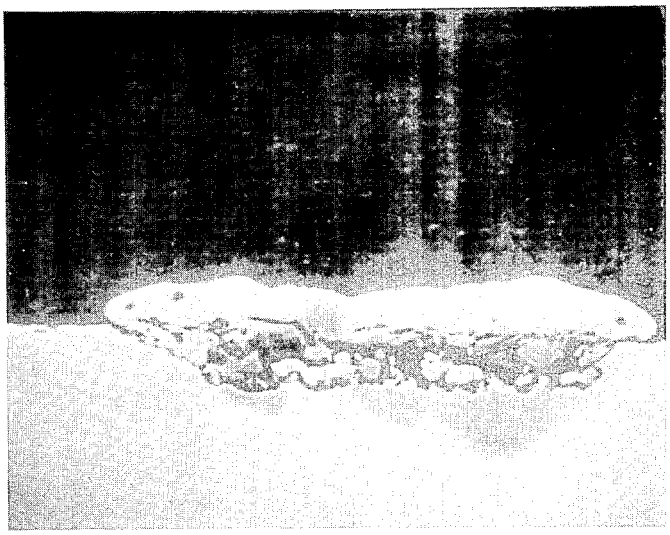
FIG. 5 is a photomicrograph at 800X of structure by vapor deposition of Example III.

FIG. 4 is a photomicrograph at 300X showing as a typical example the phosphide particles in the groove in the base coating after vapor deposition in accordance with the method of the present invention as described in Example III. FIG. 5 is a photomicrograph in cross section through the groove in the base coating containing the phosphides resulting from the vapor transfer of Example III at 800X. In contrast to the Examples I and II, there were virtually no random phosphide modules on the surface of the silicon steel resulting from the vapor deposition method.

TABLE IV

| Sample No. | Initial As-Scrubbed Properties Permeability @10H | Core Loss @1.5T (wpp) | Core Loss @1.7T (wpp) | Metal Striped Properties Permeability @10H | Core Loss @1.5T (wpp) | Core Loss @1.7T (wpp) | Properties After Vapor Deposition Treatment (5 hr/1650° F. Hydrogen) Permeability @10H | Core Loss @1.5T (wpp) | Core Loss @1.7T (wpp) |
|---|---|---|---|---|---|---|---|---|---|
| PS-1 | 1947 | .379 | .499 | 1942 | .340 (−10) | .460 | 1948 | .328 (−13) | .449 |
| PS-2 | 1927 | .370 | .513 | 1919 | .374 (+1) | .520 | 1919 | .381 (+3) | .536 |
| PS-3 | 1958 | .443 | .590 | 1949 | .347 (−22) | .463 | 1959 | .405 (−9) | .517 |
| PS-4 | 1917 | .419 | .583 | 1900 | .391 (−7) | .544 | 1918 | .376 (−10) | .521 |
| PS-5 | 1964 | .401 | .556 | 1950 | .347 (−13) | .471 | 1957 | .347 (−13) | .475 |
| PS-6 | 1954 | .369 | .487 | 1945 | .333 (−10) | .459 | 1950 | .345 (−7) | .471 |
| PS-7 | 1948 | .427 | .573 | 1936 | .342 (−20) | .470 | 1949 | .400 (−6) | .527 |
| PS-8 | 1943 | .452 | .615 | 1935 | .360 (−20) | .492 | 1948 (−7) | .421 | .569 |
| Ave. S.S. Props. | 1945 | .408 | .552 | 1935 | .354 (−13) | .485 (−12) | 1944 | .375 (−8) | .508 (−8) |
| Epstein | 1945 | .416 | .559 | | | | 1953 | .375 | .493 |

TABLE IV-continued

| Sample No. | Initial As-Scrubbed Properties Permeability @10H | Core Loss @1.5T (wpp) | Core Loss @1.7T (wpp) | Metal Striped Properties Permeability @10H | Core Loss @1.5T (wpp) | Core Loss @1.7T (wpp) | Properties After Vapor Deposition Treatment (5 hr/1650° F. Hydrogen) Permeability @10H | Core Loss @1.5T (wpp) | Core Loss @1.7T (wpp) |
|---|---|---|---|---|---|---|---|---|---|
| Pack Test on above 8 strips | | | | | | | | (−10) | (−12) |

TABLE V

| Sample No. VDTS | Initial As-Scrubbed Properties Permeability @10H | Core Loss @1.5T (wpp) | Core Loss @1.7T (wpp) | Metal Striped Properties Permeability @10H | Core Loss @1.5T (wpp) | Core Loss @1.7T (wpp) | Properties After Vapor Deposition Treatment (5 hr/1650° F. Hydrogen) Permeability @10H | Core Loss @1.5T (wpp) | Core Loss @1.7T (wpp) |
|---|---|---|---|---|---|---|---|---|---|
| 11 | 1920 | .438 | .601 | 1918 | .387 (−12) | .539 (−10) | 1904 | .409 (−7) | .576 (−4) |
| 12 | 1923 | .399 | .554 | 1916 | .403 (+1) | .551 (−1) | 1906 | .377 (−6) | .532 (−4) |
| 13 | 1885 | .503 | .704 | 1877 | .437 (−13) | .628 (−11) | 1876 | .409 (−19) | .587 (−17) |
| 14 | 1866 | .470 | .656 | 1855 | .445 (−5) | .623 (−5) | 1853 | .442 (−6) | .630 (−4) |
| 15 | 1868 | .459 | .659 | 1859 | .416 (−9) | .612 (−7) | 1860 | .420 (−8) | .612 (−7) |
| 16 | 1924 | .435 | .612 | 1912 | .377 (−13) | .529 (−14) | 1908 | .363 (−17) | .514 (−16) |
| 17 | 1937 | .420 | .596 | 1930 | .359 (−15) | .492 (−17) | 1918 | .356 (−15) | .485 (−19) |
| 18 | 1911 | .361 | .519 | 1902 | .361 (0) | .526 (+1) | 1895 | .343 (−5) | .486 (−6) |
| Ave. S.S. Props. | 1904 | .436 | .613 | 1896 | .398 (−9) | .563 (−8) | 1890 | .390 (.11) | .553 (−10) |
| Epstein | 1913 | .425 | .557 | 1905 | .390 (−8) | .548 (−2) | 1901 | .376 (−12) | .528 (−5) |
| Pack Test on above 8 strips | | | | | | | | | |

In the phosphorus attack resulting from the vapor state, any pores, cracks or defects in the surface of the forsterite coating afforded no significant degree of access for the phosphorus to the iron and thus eliminated the random dispersion of iron phosphide nodules, whereas for the surface migration type, the pores, cracks or defects in the forsterite base coating provided paths to the underlying silicon steel when the phosphides were generated on the surface.

Example IV

By way of further examples, additional tests were performed to demonstrate that prior to annealing the exposed steel to reduce the phosphorus environment, the exposed steel does not have to be subject to plastic deformation or thermal stresses in order to result in the improved core loss values. Each sample of steel having composition described above was prepared in a manner similar to that in Example I to provide a 9-mil gauge material but treated under the experimental conditions described in Table VI. Instead of using mechanical means to remove portions of the base coating and form the grooved patterns, either laser or electron beam techniques were used. To assure that any effects resulting from the laser and electron beam and providing thermal stresses to the steel which could affect magnetic properties, an intermediate anneal at 1500° F. (816° C.) in nitrogen was performed. All of the magnetic properties are single strip Epstein results.

TABLE VI

| Sample No. | Initial Properties Permeability μ10H | Core Loss @1.3T (wpp) | Core Loss @1.5T (wpp) | Core Loss @1.7T (wpp) | S.R.A. at 1500° F./Nitrogen Permeability μ10H | Core Loss @1.3T (wpp) | Core Loss @1.5T (wpp) | Core Loss @1.7T (wpp) | Phosphorus-striped 4 hrs. @ 1650° F. Permeability μ10H | Core Loss @1.3T (wpp) | Core Loss @1.5T (wpp) | Core Loss @1.7T (wpp) |
|---|---|---|---|---|---|---|---|---|---|---|---|---|
| LASER | | | | | | | | | | | | |
| LP-15-7 | 1909 | N.D. | .402 | .563 | 1909 | .293 — | .401 (0) | .568 (+1%) | 1900 | .278 | .375 (−7%) | .528 (−7%) |
| ELECTRON BEAM | | | | | | | | | | | | |
| H-16 | 1919 | N.D. | .388 | .531 | 1919 | .271 — | .380 (−2%) | .526 (−1%) | 1898 | .260 — | .350 (−10%) | .489 (−8%) |

The data of Table VI clearly demonstrate an important feature of the present invention. The magnetic property benefit through chemical striping in accordance with the present invention is in no way dependent on prior magnetic benefits attained through any technique used for removing the base coating, i.e., either through mechanical, plastic, or thermal stresses. As a result, the advantage of the present invention is that any convenient method of exposing the bare metal stripes can be used. Any effect on magnetic properties as a result of the metal striping step is both incidental and temporary with respect to the subsequent heat treatment in which the chemical striping by the phosphorus intrusion can affect properties. Although there is no intent to be bound by theory, it appears that when phosphorus is used as the main contaminant, there results a massive attack resulting from the formation and crowding of wedge-shaped particles into the matrix of the underlying steel body.

As was an object of the present invention, a method has been developed for effecting domain refinement of electrical steels which is heat resistant. Furthermore, the method has more universal application in that numerous conventional or convenient techniques may be used for removing the naturally-occurring forsterite base coating on the final texture annealed silicon steel.

Although a preferred and alternative embodiments have been described, it would be apparent to one skilled in the art that changes can be made therein without departing from the scope of the invention.

What is claimed is:

1. A method of refining the magnetic domain wall spacing of grain-oriented silicon steel sheet having an insulation base coating thereon, the method comprising:

removing portions of the base coating in a line pattern to provide a limited exposure of the underlying silicon steel, said exposed steel being free of thermal and plastic stresses;

providing the silicon steel with an environment selected from the group of phosphorus and phosphorus-bearing compounds; and thereafter, ling the exposed steel in the phosphorus environment in a reducing atmosphere at time and temperature to produce a permanent body containing a phosphorus-bearing compound in the pattern of exposed steel to effect heat resistant domain refinement and reduced core loss.

2. The method of claim 1 wherein providing the environment includes using materials selected from the group of phosphorus and phosphorus-bearing compounds in the vicinity of the exposed steel so that upon annealing, phosphorus and compounds thereof are vapor deposited on and diffused into the exposed steel.

3. The method of claim 1 wherein providing the environment includes applying to the base coated steel a coating selected from the group of phosphorus and phosphorus-bearing compounds so that upon annealing, the phosphorus and compounds thereof are diffused into the exposed steel.

4. The method of claim 3 wherein the step of removing portions of the base coating is performed before applying the phosphorus-bearing coating.

5. The method of claim 3 wherein prior to the step of annealing the silicon steel having the phosphorus coating thereon, the method includes fabricating the semi-finished sheet product into an article of manufacture and thereafter annealing to effect heat resistant domain refinement and reduced core loss.

6. The method of claim 3 wherein the phosphorus-bearing coating is a magnesia-based coating containing at least 25 percent, by weight, of phosphorus, in the dried coating.

7. The method of claim 1 wherein the step of annealing the steel uses a reducing atmosphere of substantially hydrogen.

8. The method of claim 7 wherein the step of annealing the steel includes temperatures up to 2100° F.

9. The method of claim 7 wherein the step of annealing the steel includes temperatures within a range of 1400° to 1700° F.

10. The method of claim 1 wherein the pattern comprises generally parallel lines of exposed steel extending substantially transverse to the rolling direction of the steel.

11. A method of refining the magnetic domain wall spacing of grain-oriented silicon steel sheet having a forsterite base coating thereon, the method comprising:

removing portions of the base coating in a line pattern to provide limited exposure of the underlying silicon steel, the pattern having generally parallel lines substantially transverse to the rolling direction of the steel, said exposed steel being free of thermal and plastic stresses;

applying to the base coated steel a coating selected from the group of phosphorus and phosphorus-bearing compounds thereof so that upon annealing the phosphorus and compounds thereof are diffused into the exposed steel; and thereafter, annealing the exposed steel having the phosphorus environment in a reducing atmosphere of substantially hydrogen at time and temperature of 1400° F. or more to produce a permanent body containing a phosphorus-bearing compound in the exposed steel area to effect heat resistant domain refinement and reduced core loss.

12. The method of claim 11 wherein the step of removing portions of the base coating is performed after applying the phosphorus-bearing coating.

13. A method of refining the magnetic domain wall spacing of grain-oriented silicon steel sheet having an insulation base coating thereon, the method comprising:

applying to the base coated steel a coating selected from the group of phosphorus and phosphorus-bearing compounds so that upon annealing, the phosphorus and compounds thereof are diffused into the exposed steel;

then removing portions of the base coating in a line pattern to provide a limited exposure of the underlying silicon steel, said exposed steel being free of thermal and plastic stresses; and thereafter, annealing the exposed steel in the phosphorus environment in a reducing atmosphere at time and temperature to produce a permanent body containing a phosphorus-bearing compound in the pattern of exposed steel to effect heat resistant domain refinement and reduced core loss.

14. A method of refining the magnetic domain wall spacing of grain-oriented silicon steel sheet having a forsterite base coating thereon, the method comprising:

removing portions of the base coating in a line pattern to provide limited exposure of the underlying silicon steel, the pattern having generally parallel lines substantially transverse to the rolling direction of the steel, said exposed steel being free of thermal and plastic stresses;

then applying to the base coated steel a coating selected from the group of phosphorus and phosphorus-bearing compounds thereof so that upon annealing the phosphorus and compounds thereof are diffused into the exposed steel; and thereafter, annealing the exposed steel having the phosphorus environment in a reducing atmosphere of substantially hydrogen at time and temperature of 1400° F. or more to produce a permanent body containing a phosphorus-bearing compound in the exposed steel area to effect heat resistant domain refinement and reduced core loss.

* * * * *